US007007946B1

(12) United States Patent
Dobrindt et al.

(10) Patent No.: US 7,007,946 B1
(45) Date of Patent: Mar. 7, 2006

(54) DEVICE FOR DEPOSITING SHEETS ON A STACK

(75) Inventors: Dirk Dobrindt, Klausdorf/Schwentine (DE); Lutz Rebetge, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/344,555

(22) PCT Filed: Feb. 22, 2000

(86) PCT No.: PCT/EP00/01424

§ 371 (c)(1),
(2), (4) Date: May 1, 2003

(87) PCT Pub. No.: WO00/50325

PCT Pub. Date: Aug. 31, 2000

(30) Foreign Application Priority Data

Feb. 25, 1999 (DE) ..... 199 07 977

(51) Int. Cl.
*B65H 29/34* (2006.01)

(52) U.S. Cl. ..... 271/189; 271/220; 414/794.8

(58) Field of Classification Search ..... 271/278, 271/220, 221, 314, 189, 207; 414/907, 794.8
See application file for complete search history.

(56) References Cited

U.S. PATENT DOCUMENTS 4,359,218 A * 11/1982 Karis ..... 271/188
4,406,449 A * 9/1983 Buck ..... 271/189
4,647,265 A * 3/1987 Uno ..... 414/790.2
4,796,879 A * 1/1989 Martini et al. ..... 271/218
5,803,227 A * 9/1998 Stein et al. ..... 194/206

FOREIGN PATENT DOCUMENTS

DE 1113182 * 8/1961
EP 0674222 * 9/1995
WO WO 90/15770 * 12/1990

OTHER PUBLICATIONS

Fuji Xerox Co. Ltd, Sheet Accommodating Device to Intermediate Tray of Copying Machine, Jun. 27, 1989, European Patent Office, Patent Abstracts of Japan, Publication No. 01162677.*

Sanyo Electric Co. Ltd., Paper Sheet Storage Device, Jun. 10, 1997, European Patent Office, Patent Abstracts of Japan, Publication No. 09151012.*

* cited by examiner

*Primary Examiner*—Donald P. Walsh
*Assistant Examiner*—Thomas Morrison
(74) *Attorney, Agent, or Firm*—Lawrence P. Kessler

(57) ABSTRACT

Apparatus for depositing sheets on a stack, which permits essentially free access to the stack and can be implemented with a low outlay of materials and costs. The apparatus includes on the side of the stack (1) that faces a machine, tongues (5, 6) with which frictional elements (3, 4) can be brought into and out of contact and which can be moved in the conveying direction (10) of the sheets (2) and in the opposite direction, and can be lowered onto the stack (1), and wherein on the side of the stack (1) that faces the machine, at least one hold-down (7) is provided which can be moved in the conveying direction (10) of the sheets (2) and in the opposite direction, and can be lowered onto the stack (1).

5 Claims, 9 Drawing Sheets

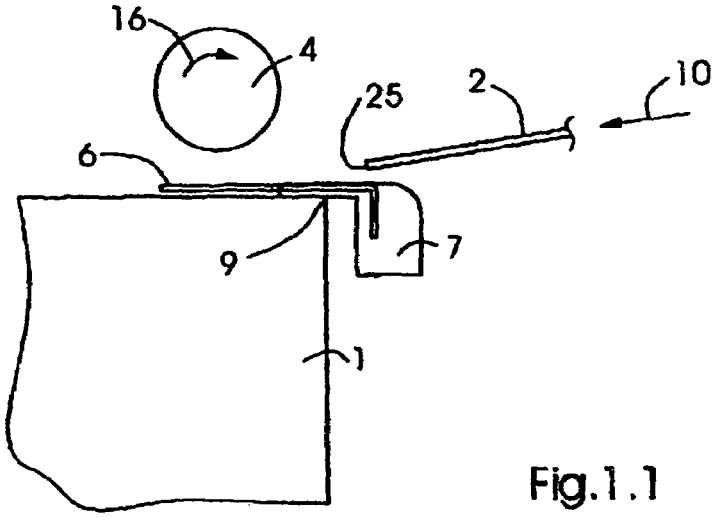
Fig.1.1
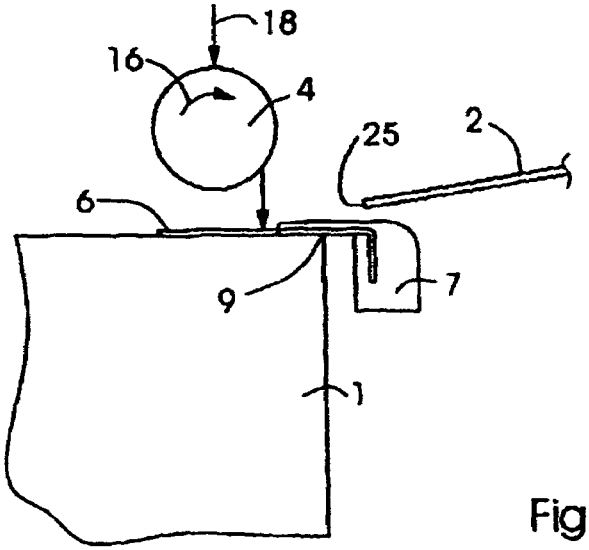
Fig.1.2
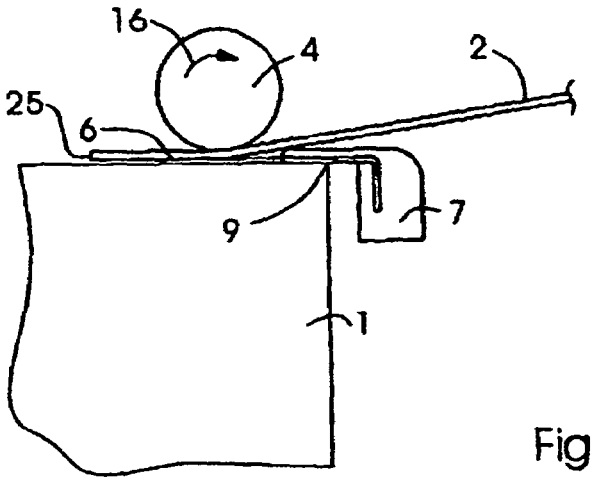
Fig.1.3

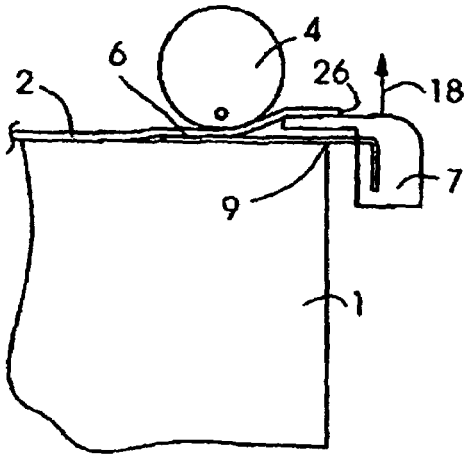
Fig.1.4
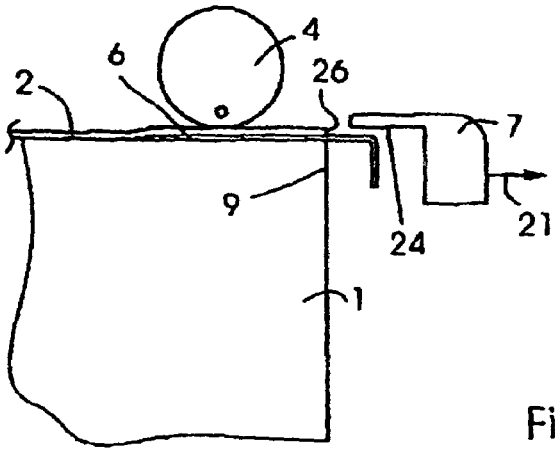
Fig.1.5
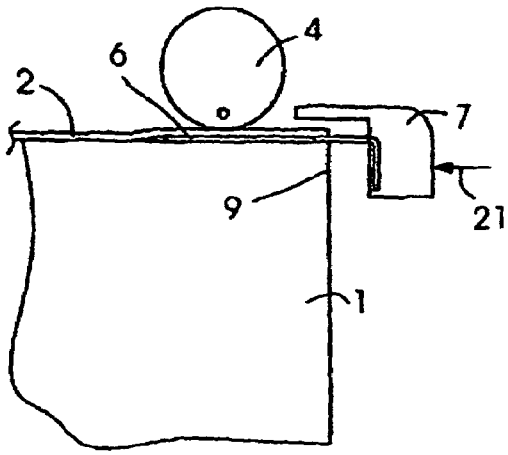
Fig.1.6

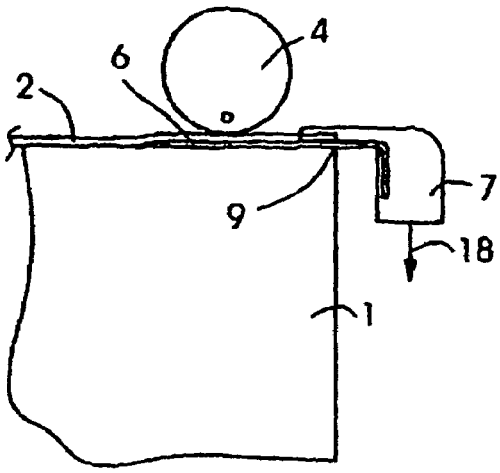
Fig.1.7
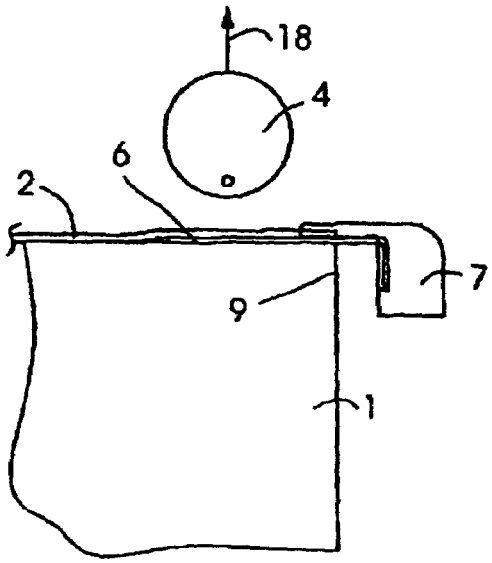
Fig.1.8
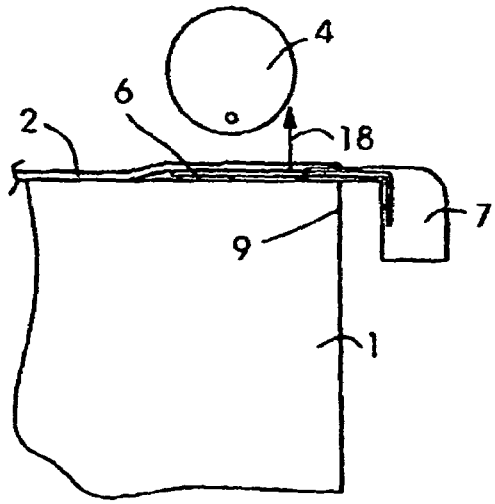
Fig.1.9

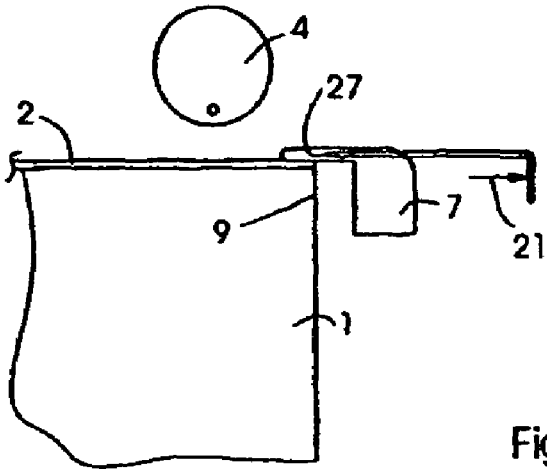
Fig.1.10
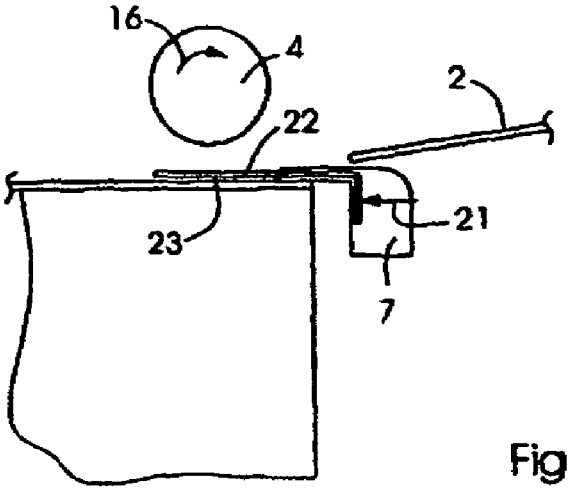
Fig.1.11
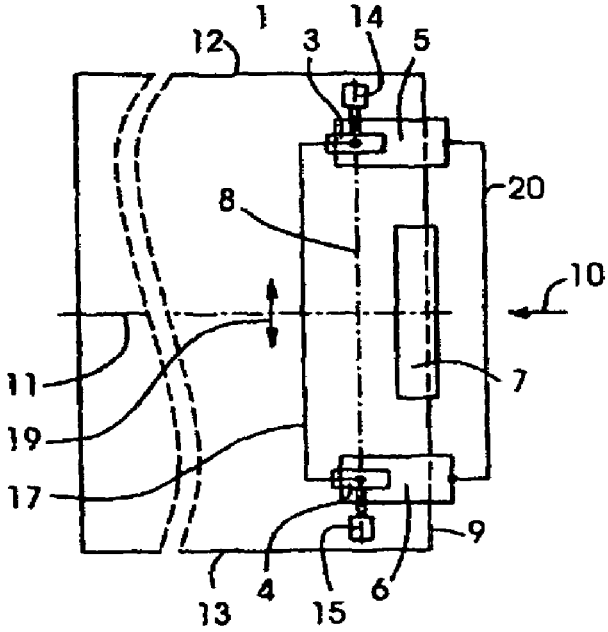
Fig.2

DEVICE FOR DEPOSITING SHEETS ON A STACK

FIELD OF THE INVENTION

The invention relates to an apparatus for depositing sheets on a stack.

BACKGROUND OF THE INVENTION

Apparatus is known for depositing sheets on a stack, which apparatus is arranged downstream, for example, of a printing machine. Such apparatus uses grippers that are arranged on endless chains, open under cam control and allow a sheet to fall in order to form a stack. Allowing the sheet to fall can be improved by using suction air and blower devices, by the conveying speed being retarded considerably and by the falling movement being accelerated. In order to improve the exactness of the stack formation, the sheets to be deposited are brought up against a stop and aligned using rectilinear joggers acting on side edges. In the environment of the stack there is a large number of constructional elements requiring high outlay of materials and costs, which also impair operator accessibility to the stack for handling and inspection activities. The moving parts in the sheet stack area of a printing machine constitute a safety risk, so that the sheet stack area is enclosed to the greatest possible extent. In order to remove a proof sheet, appropriate additional apparatus, such as flaps or diverters, can be provided, which necessitates additional outlay.

SUMMARY OF THE INVENTION

The object of the invention is to develop an apparatus for depositing sheets on a stack, which permits essentially free access to the stack and can be implemented with a low outlay of materials and costs.

The elements provided for depositing the sheets are located essentially so as to face the sheet-processing or sheet-inspecting machine. The elements act on the trailing end of the sheets and occupy only a low volume. Free accessibility to three sides of the stack is provided. If the sheets are deposited with the imprint on the top, the printed image can be inspected easily, since only a small area is covered by such elements and the light conditions for the inspection are optimal. The stack can be transported away without hindrance. If the frictional elements are independently driven rollers, a skewed position of a sheet can be compensated for. If, in addition, the frictional elements can be moved transversely with respect to the conveying direction of the sheets, the lateral position of the sheets can be adjusted. The apparatus has only a few elements with a low volume. Stops or deposit containers predefining the form of the stack are not necessary. The widest possible range of sheet format can be deposited, without adjustments of any kind being needed.

BRIEF DESCRIPTION OF THE DRAWINGS

The invention is to be explained in more detail below using the exemplary embodiments. In the drawings:

FIGS. 1.1 through 1.11 show a schematic side view of the apparatus, at various stages of operation;

FIG. 2 shows a schematic plan view of the apparatus; and

DETAILED DESCRIPTION OF THE INVENTION

Figure 3:
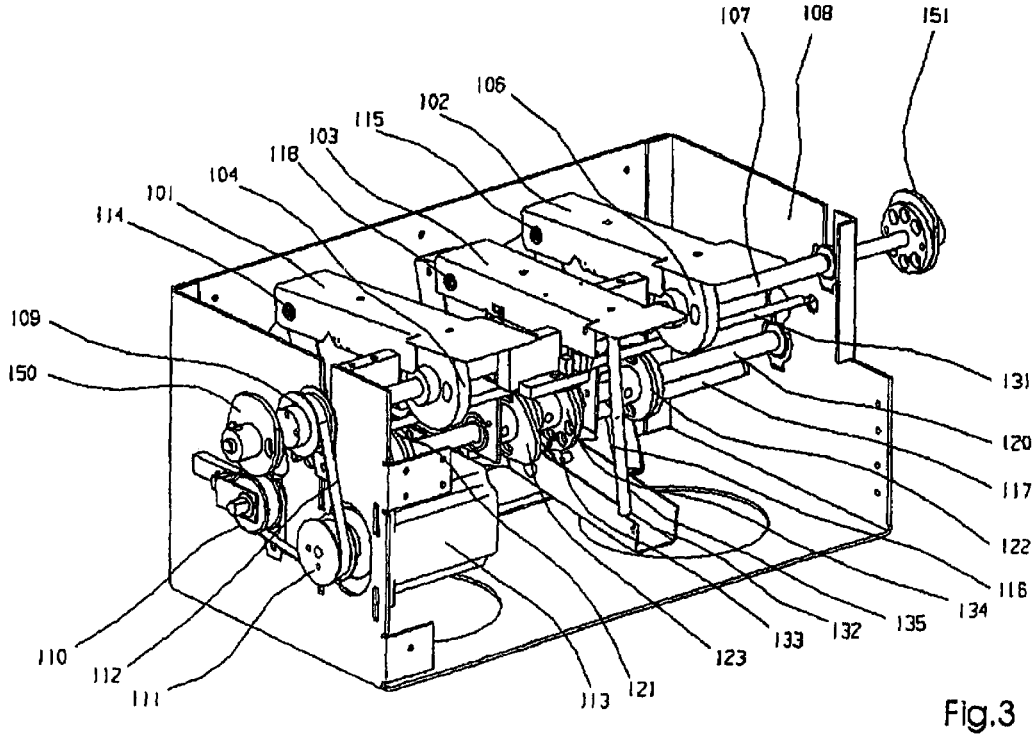
FIGS. 3 through 7 show an embodiment with control cams.

Those parts of the apparatus, which are essential to the invention are illustrated schematically in side view and plan view in FIGS. 1.1 through 1.11 and 2. FIGS. 1.1 through 1.11 show a stack 1, onto which sheets 2 are to be deposited horizontally upon one another. For this purpose, two rollers 3, 4, two tongues 5, 6, and hold-down 7 are provided. The axes of rotation of the rollers 3, 4 are aligned along a line 8, which is parallel to the upper, rear stack edge 9 and perpendicular to the conveying direction 10. In the lateral direction, the rollers 3, 4 are arranged symmetrically with respect to the mid-line 11 of the stack 1, in the vicinity of the side edges 12, 13 of the stack 1. The rollers 3, 4 are driven independently of one another by stepping motors, so that the rollers 3, 4 can rotate at different speeds in the direction of the arrow 16.

The rollers 3, 4, together with the stepping motors, are fixed to a common frame 17. The frame 17 with the rollers 3, 4 is provided such that it can be raised and lowered in the vertical direction 18 and positioned in the lateral direction 19. On their surface, the rollers 3, 4 are provided with an elastic material, so that when they are in contact with a sheet 2, the result is a high coefficient of friction. The tongues 5, 6 are located in the lateral direction at the level of the rollers 3, 4. The tongues 5, 6 are very flat, arranged parallel to the surface of the stack 1 and fixed to a frame 20. The frame 20 with the tongues 5, 6 can be positioned in the vertical direction 18 and in the horizontal direction 21. The surface 22 of the tongues 5, 6 facing the rollers 3, 4 is polished and, in relation to the sheet material, has a low coefficient of friction. The surface 23 of the tongues 5, 6 facing the upper side of the stack can have a high coefficient of friction in relation to the sheet 2 located underneath. The hold-down 7 acts in the center on the rear stack edge 9. The hold-down 7 is likewise arranged such that it can be positioned in the horizontal and vertical direction 18 and 21. The underside 24 of the hold-down 7 has a high coefficient of friction in relation to the sheet 2 located underneath.

The mode of action of the apparatus is to be explained using eleven component pictures FIGS. 1.1 through 1.11: in the initial state (FIG. 1.1) the rollers 3, 4 and the tongues 5, 6 are raised, in each case, in their uppermost vertical position. The hold-down 7 presses with its underside 24 on the top sheet of the stack 1 and fixes it. The rollers 3, 4 rotate at a circumferential speed, which corresponds to the conveying speed of a sheet 2 output from a printing machine. The conveying direction 10 is inclined with respect to the horizontal direction 21 in such a way that the sheet 2, beginning with its leading edge 25, can slide along on the smooth surface 22 of the tongues 5, 6.

In the state shown in FIG. 1.2, the tongues 5, 6 have been lowered onto the stack 1, and the rollers 3, 4 have been lowered to about half their maximum height above the stack 1. As the sheet 2 is advanced further, the leading end is located under the rollers 3, 4, as illustrated in FIG. 1.3. The rollers 3, 4 press the sheet 2 against the surface 22. The sheet 2 is conveyed onward by the rotation of the rollers 3, 4. The stepping motors of the rollers 3, 4 are stopped when the trailing edge 26 of the sheet 2 has reached the rear stack edge 9. This state is shown in FIG. 1.4.

After the rollers 3, 4 have stopped, the hold-down 7 is lifted off the stack 1 and, as illustrated specifically in FIG. 1.5, displaced in the horizontal direction 21 in the direction opposite to the conveying direction 10 of the sheet 2, so that the front end 27 of the hold-down 7 is still located in front of the rear stack edge 9. At the same time, the sheet 2 is deposited onto the stack 1 in the area between the tongues 5, 6. As the hold-down 7 is drawn away, the sheet 2 remains fixed in position by the rollers 3, 4. As shown in FIGS. 1.6 and 1.7, the hold-down 7 is placed onto the rear end of the stack 1 again by a horizontal movement and a vertical movement. The hold-down 7 then takes over the action of fixing the top sheet 2 in position.

The rollers 3, 4 can be lifted off the stack 1, as shown in FIG. 1.8. In subsequent steps (FIGS. 1.8 and 1.9), the tongues 5, 6 are lifted off the stack 1 and drawn back in the horizontal direction 21 to such an extent that the front end 27 of the tongues 5, 6 is still located in front of the rear stack edge 9. The sheet 2, which continues to be fixed by the hold-down 7, is deposited entirely on the stack 1. In a last step, as illustrated in FIG. 1.11, the tongues 5, 6 are moved back into the position above the stack 1 and under the rollers 3, 4. The rollers 3, 4 are set rotating, which produces the initial state, described in FIG. 1.1, for the deposition of the next sheet 2.

The stepping motors of the rollers 3, 4 can be constituent parts of a position control loop for the sheets. For this purpose, detectors for the position of the sheet 2 in relation to the stack edges can be provided. By comparing the actual position with a desired position, actuating signals can be derived which, in the step according to FIG. 1.3, drive the rollers 3, 4 at different circumferential speeds in such a way that a skewed position of a sheet is compensated for. In the step according to FIG. 1.4, the frame 17 with the rollers 3, 4 can be positioned further in the direction 19, by which any lateral offset of the sheet 2 in relation to the stack 1 can be compensated for or can be produced deliberately.

FIGS. 3 through 7 show an exemplary embodiment in which two tongues 101, 102 and a hold-down 103 arranged between the tongues 101, 102 can be raised and lowered from a stack (not further illustrated) with the aid of cam disks 104–106. The cam disks 104–106 are firmly seated on a shaft 107, which is mounted in a frame 108. In order to drive the shaft 107, a toothed-belt gear mechanism is used, having toothed-belt pulleys 109–111, a toothed belt 112, and a motor 113 fixed to the frame 108. The tongues 101, 102 are connected via rotary joints 114, 115 to a common holding plate 116 which is essentially arranged horizontally and which is mounted such that it can be pivoted on a shaft 117 held in the frame 108. The hold-down 103 is likewise connected via a rotary joint 118 to a holding plate 119, which is also mounted such that it can be pivoted on the shaft 117.

Mounted in the frame 108 is a further shaft 120, which is located parallel to the shaft 107 and on which cam disks 121–123 are fixed. The cam disks 121–123 roll on grooved ball bearings 124 (FIG. 5), which are located in the U-shaped holding plates 116, 119. As the bottom view of FIG. 4 reveals, the cam disks 104–106 slide on sliding coverings 125–127, which are located under the tongues 101, 102 and under the hold-down 103. The shaft 120 is driven synchronously with the shaft 107 by the toothed-belt pulley 110. In order to prevent the tongues 101, 102, the hold-down 103 and the holding plates 116, 119, all of which are moved in operation, from lifting off the cam disks 104–106, 121–123, tension springs 128–130 are provided, which are fixed to a shaft 131 fixed in the frame 108. On the shaft 117, close to the holding plate 119, a tension holding plate 132 is mounted such that it can be pivoted. Provided in the tension holding plate 132 is a further grooved ball bearing 133, which interacts with a cam disk 134, which is likewise fixed to the shaft 120. A tension spring 135 connects the hold-down 103 to the grooved ball bearing 133 in the tension holding plate 132.

Figure 4:
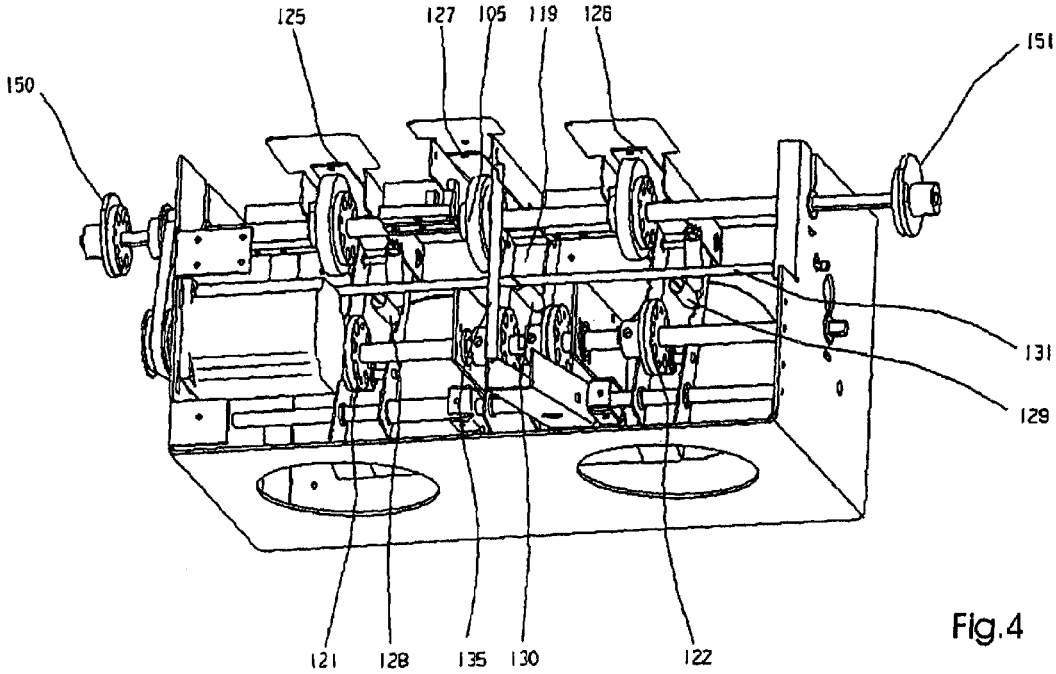
Figure 5:
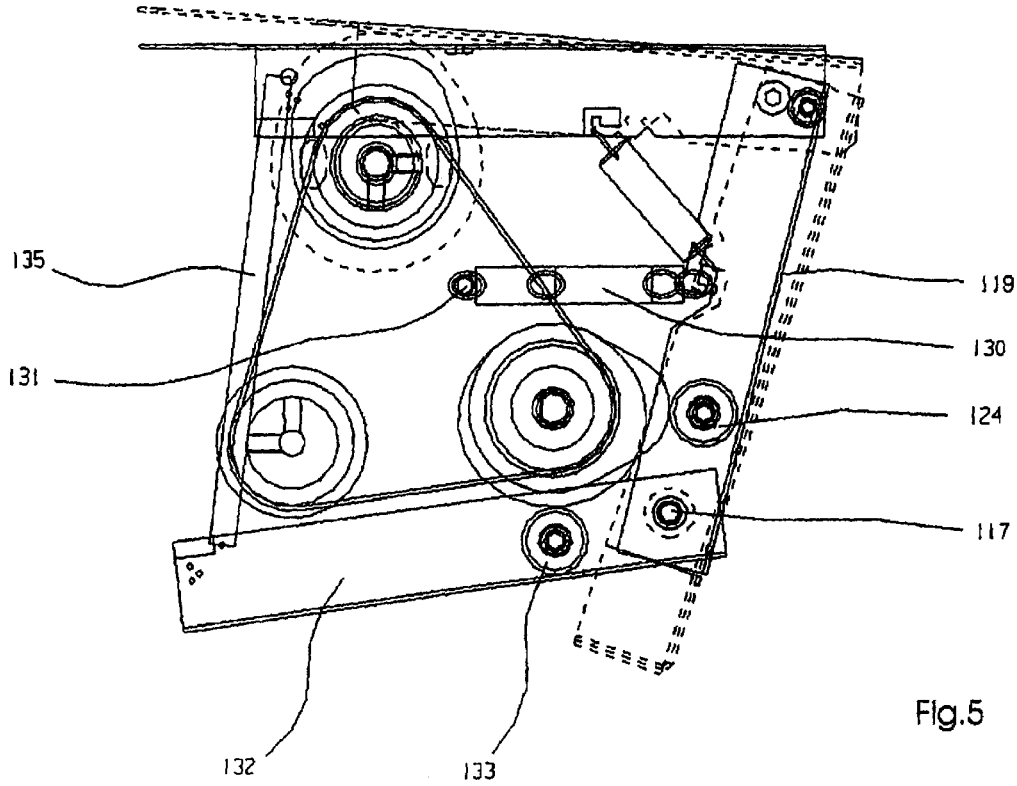
Figure 6:
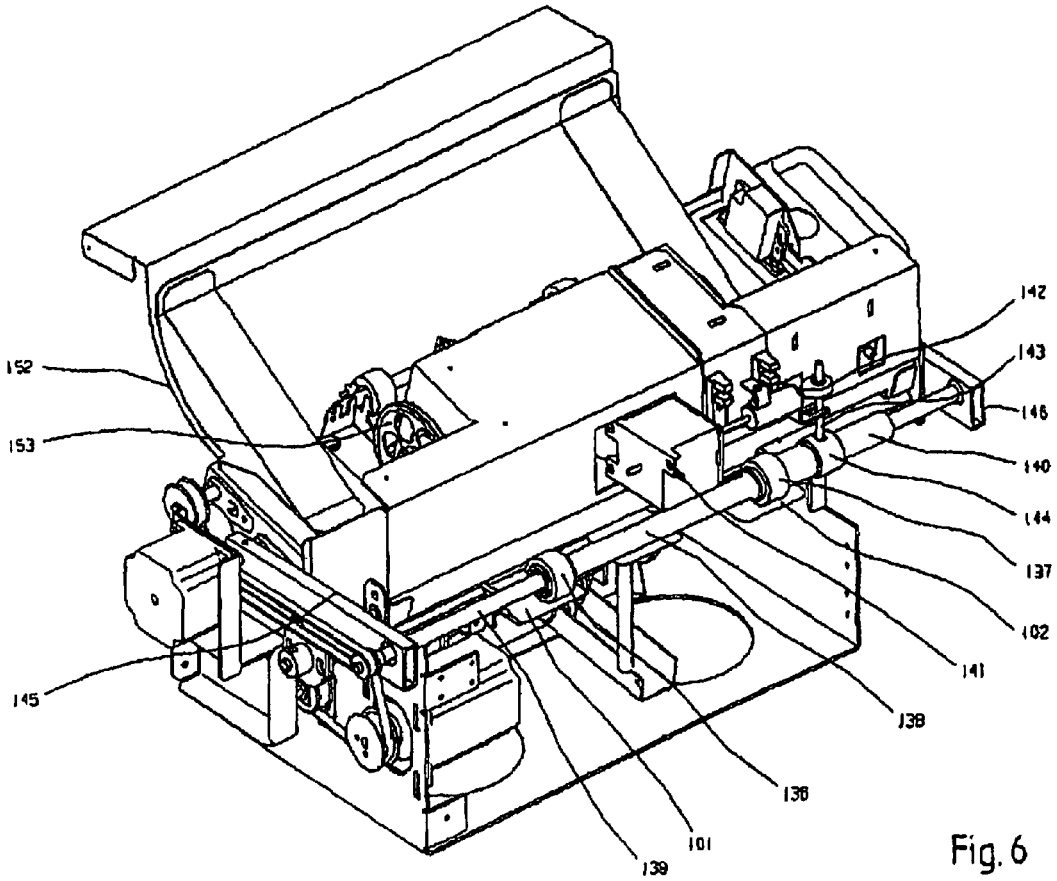
Figure 7:
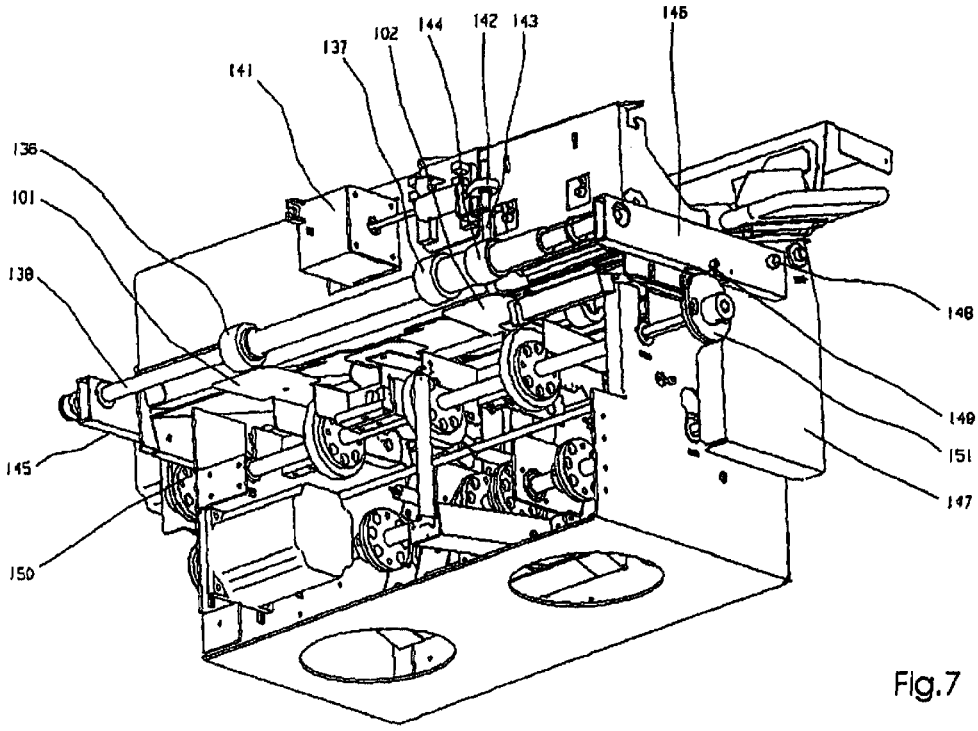

Mounted above the elements described in FIGS. 3 through 5 is a subassembly shown in more detail in FIGS. 6 and 7. The subassembly contains offset rollers 136, 137, which interact with the tongues 101, 102. The offset rollers 136, 137 are fixed to an aluminum tube 138. The aluminum tube 138 is guided in sliding bearings such that it can be displaced on a drive shaft 139. By a bushing 140 which is provided with a longitudinal slot, and with the aid of a pin that is screwed into the drive shaft 139, the torque is transmitted to the offset rollers 136, 137 by the drive shaft 139, which is driven by a stepping motor. A stepping motor 141 with attached spindle effects the lateral displacement of the offset rollers 136, 137 on the drive shaft 139. The forces for the lateral displacement of the offset rollers 13.6, 137 are transmitted by an articulated head 142, which is secured against rotation on the spindle.

Guided in the articulated head 142 is a rod 143, which is screwed into a setting ring 144, which is not rotated at the same time. The articulated head 142 and the rod 143 are necessary in order to raise the offset rollers 136, 137 off the tongues 101, 102. When the offset rollers 136, 137 are being raised, the rod 143 is able to slide through the articulated head 142 with a clearance fit. The raising action is achieved via lateral lever arms 145, 146. The lever arms 145, 146 are mounted in a holder 147 such that they can be pivoted about a shaft 148.

When the upper subassembly is put together with the lower subassembly, grooved ball bearings 149 fixed on the lever arms 145, 146 rest on cam disks 150, 151 which are fixed to the shaft 107. The upper subassembly includes a paper feed 152, a pair of rollers 153 being provided in the transport path of the sheets. The rollers of the pair of rollers 153 can be driven independently of one another by motors, by which a skewed sheet can be aligned by accelerating one of the rollers. Following the alignment of a sheet, its lateral position can be registered, for example using a linear CCD. Using computing means, the difference between the center of the sheet and the theoretically accurate central position of the sheet can be determined, and can be corrected with the aid of the lateral displacement of the offset rollers 136, 137. The correction to the deviation of the sheet centers from the center of the paper path is carried out in a similar manner as well during the production of sheet stacks with sheets located so as to be offset.

The cam disks 104–106, 121–123, 134, 150, and 151 have the corresponding phase angles and geometries corresponding to the movement sequence already described in relation to FIGS. 1.1 through 1.11 and 2. The entire holding and depositing procedure is run through with one revolution of the shaft of the motor 113.

In the following text, the intention is to discuss the function of the above-described elements in more detail. The tension holding plate 132 and the tension spring 135, in conjunction with the cam disk 134, have the effect of completely relieving the tension on the hold-down 103 shortly before the hold-down 103 is drawn out of the interspace between a newly deposited sheet and the stack already formed. In this state, the hold-down 103 does not exert any holding forces on the stack. While the hold-down 103 is being relieved of tension and drawn out of the stack, the tongues 101, 102 perform the clamping of the top sheets. The sheet newly deposited above the tongues 101, 102 is held by the offset rollers 136, 137.

Before the tongues 101, 102 are drawn back out of the stack and the hold-down 103 takes over the clamping of the sheet stack, the tongues 101, 102 are first raised considerably from the sheet stack by the cam disks 104, 106. It would also be possible to implement a tension-relieving operation as has already been described in relation to the hold-down 103. A few milliseconds before the tongues 101, 102 are raised, the raising of the offset rollers 136, 137 begins, brought about by the cam disks 150, 151. This premature raising of the offset rollers 136, 137 off the tongues 101, 102 is necessary in order that the sheet conveyed out between the offset rollers 136, 137 and the tongues 101, 102 is released and ultimately held only by the hold-down 103. As the tongues 101, 102 are raised, the two lateral sheet edges are raised to a slight extent at the same time. When the tongues 101, 102 are drawn away from the sheet stack 1, by the cam disks 121, 122 in the next step, then the sheet stack 1 is released by tongues 101, 102, and the conveyed sheet is deposited on the already existing stack 1.

The cam disks 104, 106, 121, 122 are such that as the tongues 101, 102 are advanced quickly over the stack, the tongues 101, 102 remain in a raised position, so that they can be moved safely over the stack. Only shortly before the final position of the tongues 101, 102 as they are advanced rapidly over the stack are the tongues 101, 102 lowered onto the stack by the cam disks 104, 106. A newly conveyed sheet can subsequently move onto the stack over the tongues 101, 102, the offset rollers 136, 137 still being in a raised position because of the cam disks 150, 151; that is to say, there is no contact between the tongues 101, 102 and the offset rollers 136, 137. Before the offset rollers 136, 137 are lowered by the cam disks 150, 151, the offset rollers 136, 137 are brought up to sheet advance speed. After the offset rollers 136, 130.7 have been lowered, these take over the sheet transport onto the stack still before the pair of rollers 153 releases the sheet in the paper feed 152. The correction to the skewed position of a sheet by the pair of rollers 153 is concluded before the offset rollers 136, 137 are placed on said sheet.

In the paper feed 152, in the conveying path of the sheet and directly downstream of the pair of rollers 153, two detectors for the sheet trailing edge can be provided spaced apart from one another perpendicularly in the conveying direction. As a result, the sheets can be deposited irrespective of their format. The detector signals are used to start the motor 113 and to correct the skewed position of the sheets. Following each deposition cycle, the deposition system finds itself in a rest position, in which the hold-down 103 rests on the sheet stack, the tongues 101, 102 are in the withdrawn position and the offset rollers 136, 137 are raised.

In addition to the variants described above, however, the sheet leading edge can also be detected. For this purpose, the information relating to the sheet length must be made available to the deposition system. Using this information, the appropriate time delay for the starting point of the deposition cycle is then determined.

The invention has been described in detail with particular reference to certain preferred embodiments thereof, but it will be understood that variations and modifications can be effected within the spirit and scope of the invention.

PARTS LIST

1 Stack
2 Sheet
3, 4 Roller
5, 6 Tongue
7 Hold-down
8 Line
9 Stack edge
10 Conveying direction
11 Mid-line
12, 13 Side edges
14, 15 Stepping motors
16 Arrow
17 Frame
18 Direction
19 Direction
20 Frame
21 Direction
22, 23 Surface
24 Underside
25 Leading edge
26 Trailing edge
27 End
101, 102 Tongue
103 Hold-down
104–106 Cam disks
107 Shaft
108 Frame
109–111 Toothed-belt pulleys
112 Toothed belt
113 Motor
114, 115 Rotary joint
116 Holding plate
117 Shaft
118 Rotary joint
119 Holding plate
120 Shaft
121–123 Cam disk
124 Grooved ball bearing
125–127 Sliding covering
128–130 Tension spring
131 Shaft
132 Tension holding plate
134 Cam disk
135 Tension Spring
136, 137 Offset roller
138 Aluminum tube
139 Drive shaft
140 Bush
141 Stepping motor
142 Articulated head
143 Rod
144 Setting ring
145, 146 Lever arms
147 Mounting
148 Shaft
149 Grooved ball bearing
150, 151 Cam disk
152 Paper feed
153 Pair of rollers

What is claimed is:

1. Apparatus for depositing sheets, conveyed in a conveying direction, on a stack, comprising: rotating frictional elements (3, 4), said rotating frictional elements (3, 4) being rotatable at different speeds to accommodate for sheet skew and being movable in the vertical direction (18) perpendicular to the conveying direction (10) of sheets (2) to be lowered onto the stack (1), a device for conveying sheets from a printing machine over the stack into the active range of said rotating frictional elements, on the side of the stack (1) that faces the printing machine, tongues (5, 6) with which said rotating frictional elements (3, 4) can be brought into and out of contact and which can be moved in the conveying direction (10) of sheets (2) and in the opposite direction and can be lowered onto the stack (1), and wherein on the side of the stack (1) that faces the printing machine, at least one hold-down (7) is provided which can be moved in the conveying direction (10) of sheets (2) and in the opposite direction and can be lowered onto the stack (1).

2. The apparatus as claimed in claim 1, wherein said rotating frictional elements (3, 4) are two rollers arranged coaxially and transversely with respect to the conveying direction (10).

3. The apparatus as claimed in claim 2, wherein said rollers (3, 4) can be adjusted transversely with respect to the conveying direction (10) during the conveying operation.

4. The apparatus as claimed in claim 1, wherein the respective surfaces (22) of said tongues (5, 6) that face said rotating frictional elements (3, 4) respectively have a significantly lower coefficient of friction than the surfaces (23) that face the stack.

5. The apparatus as claimed in claim 1, wherein said at least one hold-down (7), acts by friction, for sheets (2), on the trailing end of a sheet (2) that has been aligned with and deposited on the stack (1).

* * * * *